US006168451B1

(12) United States Patent
Lin et al.

(10) Patent No.: US 6,168,451 B1
(45) Date of Patent: Jan. 2, 2001

(54) ELECTRICAL CONNECTOR ASSEMBLY

(75) Inventors: Nick Lin, Hsin-Chuang; Shih-Tsang Yang, Tai-Chunag, both of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/298,370

(22) Filed: Apr. 22, 1999

(30) Foreign Application Priority Data

Dec. 28, 1998 (TW) ..... 87221642

(51) Int. Cl.[7] ..... H01R 13/62
(52) U.S. Cl. ..... 439/331; 439/73
(58) Field of Search ..... 439/66, 70, 71, 439/73, 331

(56) References Cited

U.S. PATENT DOCUMENTS 5,588,847 * 12/1996 Tate ..... 439/71
5,669,783 * 9/1997 Inoue et al. ..... 439/331
5,829,988 * 11/1998 McMillan et al. ..... 439/70

* cited by examiner

*Primary Examiner*—Khiem Nguyen
(74) *Attorney, Agent, or Firm*—Wei Te Chung

(57) ABSTRACT

An electrical connector assembly for connecting a chipset to a printed circuit board comprises a dielectric housing having a number of terminal-receiving passageways defined between a top mating face and a bottom terminating face thereof. Two connecting protrusions are respectively formed on opposite sides of the housing. A number of terminals are received in the passageways of the housing. Each terminal has a contact portion and a tail portion extending from the contact portion. A fastening piece is attached to the housing, and includes a body and two legs extending substantially perpendicular from opposite ends of the body. Each leg defines a mating groove on an inner face thereof for mating with the corresponding connecting protrusion of the housing. When the fastening piece is mounted to the housing, the chipset is securely sandwiched between the fastening piece and the housing, and when the fastening piece is removed from the housing, the chipset can be easily detached from the housing.

6 Claims, 4 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly for electrically connecting a chipset to a printed circuit board.

2. Description of Prior Art

The trend of the computer industry is continuing toward improvement of functional abilities, miniaturization of electrical component, and convenience of assembly. A conventional chipset is connected to a printed circuit board by soldering contact tails of the chipset to the board. Since the tails of the chipset are densely arranged, the soldering procedure is inconvenient. Furthermore, if the chipset requires replacement, it cannot be easily removed from the PCB. Thus, the conventional assembly process is inadequate and does not follow the trend of the computer industry.

To overcome the problems mentioned above, some chipsets are detachably mounted to a print circuit board by mating the contacts of the chipset with the resilient terminals of a connecting component, and then attaching the connecting component to the PCB. However, when a force is exerted on the chipset, disconnection with the connecting component may occur.

SUMMARY OF THE INVENTION

Accordingly, an object of the present invention is to provide an electrical connector assembly having a fastening piece for facilitating retention of a chipset therein.

In the preferred embodiment of the present invention, an electrical connector assembly comprises a dielectric housing having a plurality of terminal receiving passageways defined between a top mating face and a bottom terminating face thereof, and connecting protrusions formed opposite sides thereof. A plurality of terminals is received in the passageways of the housing. Each terminal has a contact portion and a tail portion extending from the contact portion. A fastening piece is attached to the housing, and includes a body and legs extending substantially perpendicular from opposite ends of the body. Each leg defines a mating groove on an inner face thereof for mating with the corresponding connecting protrusion of the housing. When the fastening piece is mounted to the housing, a chipset is securely sandwiched between the fastening piece and the housing, and when the fastening piece is removed from the housing, the chipset can be easily detached from the housing.

BRIEF DESCRIPTION OF THE DRAWINGS

Other objects and advantages of the present invention will be understood from the following description of an electrical connector assembly according to a preferred embodiment of the present invention shown in the accompanying drawings, in which.

DETAILED DESCRIPTION OF THE PREFERRED EMBODIMENT

Figure 1:
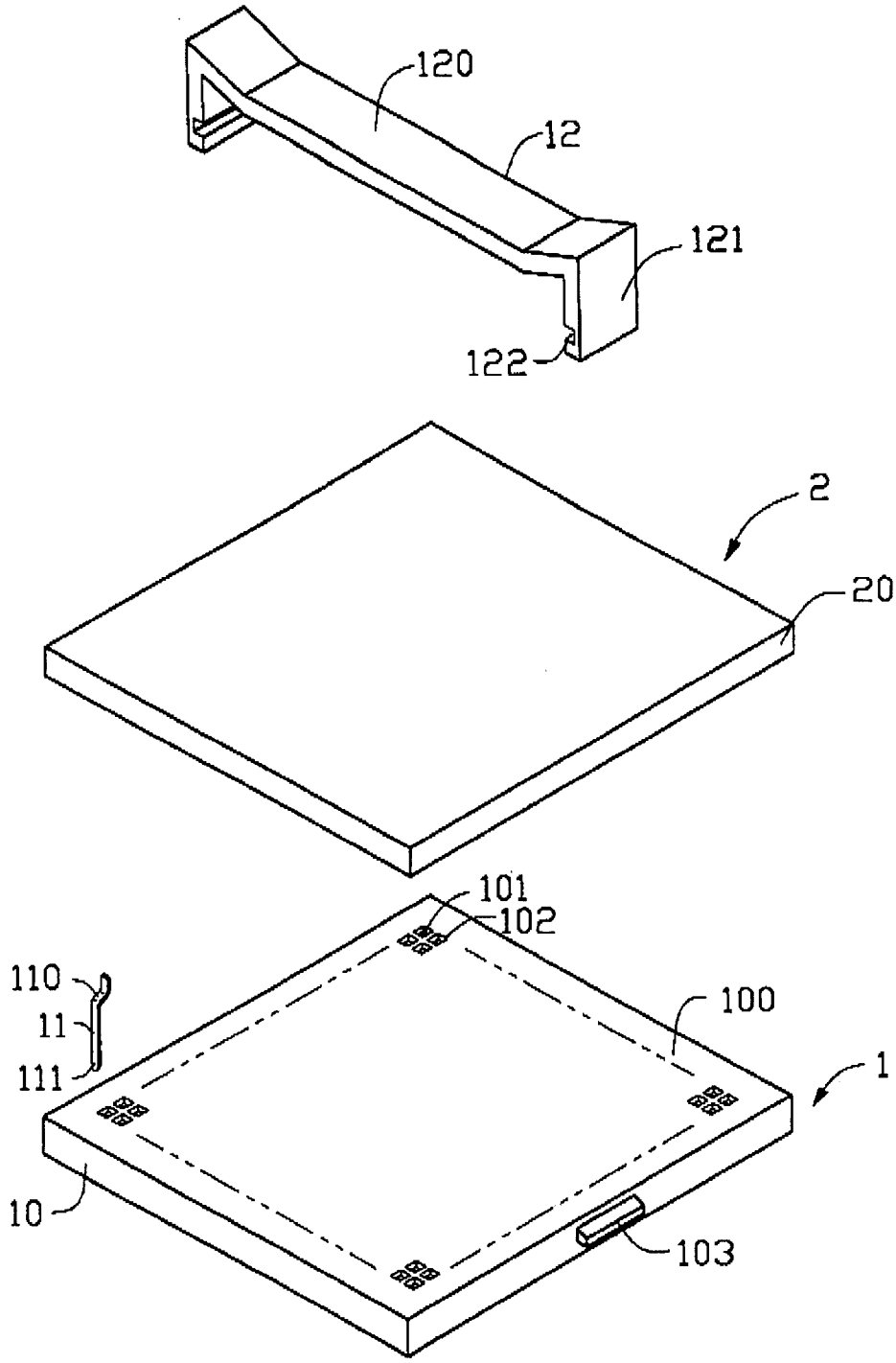
FIG. 1 is an exploded view of an electrical connector assembly embodying the concepts of the present invention.

Referring to FIG. 1, an electrical connector assembly in accordance with the present invention mounted to a printed circuit board (not shown) includes a connector 1 and a chipset 2 comprising a main body 20 and a plurality of solder balls 21 (see FIG. 4) located on the main body 20 for electrically connecting with the connector 1. The connector 1 comprises a dielectric housing 10, a plurality of electrical terminals 11, and a fastening piece 12. The housing 10 has a top mating face 100 for mating with the chipset 2 and a bottom terminating face (not labeled) for mounting to the printed circuit board. A plurality of passageways 101 is defined between the top mating face 100 and the bottom terminating face of the housing 10, and two connecting protrusions 103 are formed on opposite sides thereof. Receiving recesses 102 are formed in the top mating face 100 in communication with the corresponding passageways 101 for receiving the solder balls 21 of the chipset 20. Each connecting protrusion 103 has a slant outwardly extending from the corresponding side proximate the top mating face 100, as shown in FIG. 3.

The terminals 11 are received in the corresponding passageways 101 of the housing 10. Each terminal has a contact portion 110 and a tail portion 111 extending from the contact portion 110. The contact portion 110 of the terminal 11 is positioned in the receiving recess 102 and forms a curved, resilient end for mating with the solder ball 21 of the chipset 2.

The fastening piece 12 comprises a main body 120 extending slightly upward at distal ends thereof and two legs 121 downwardly extending substantially perpendicular from the distal ends of the main body 120. The distance between the legs 121 is substantially equal to the distance between the connecting protrusions 103 of the housing 10. A mating groove 122 is defined in an inner face of each leg 121 for engaging with the corresponding connecting protrusion 103 of the housing 10.

Figure 2:
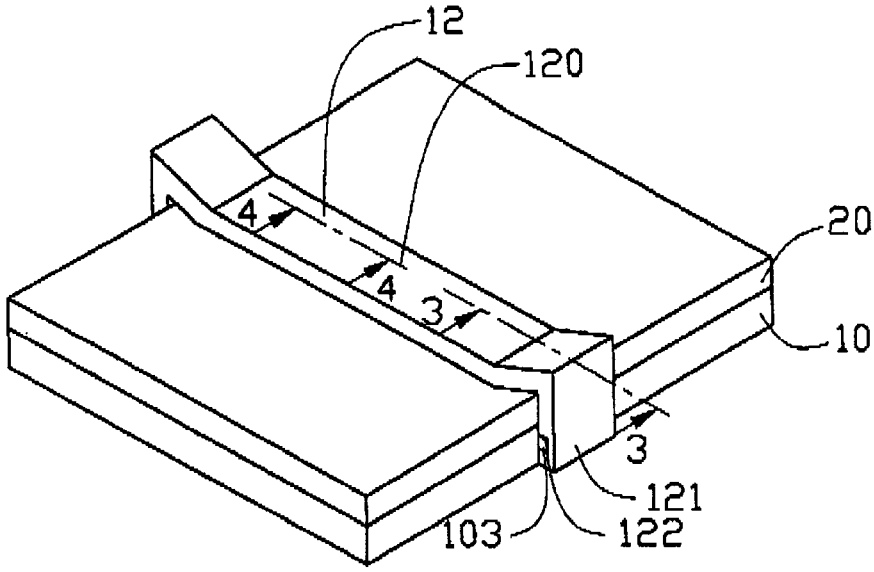
FIG. 2 is an assembled view of FIG. 1.
Figure 3:
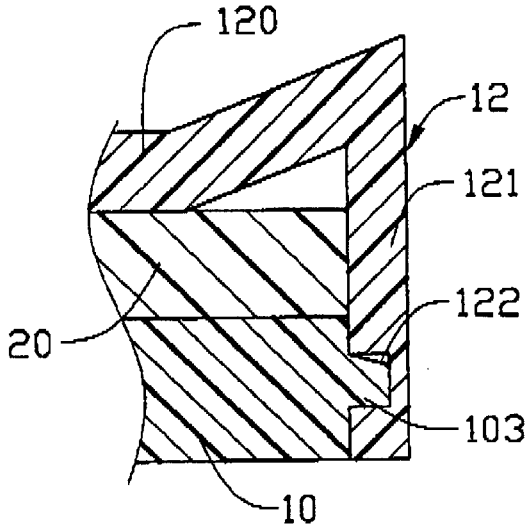
FIG. 3 is a partial cross-sectional view taken along line 3—3 of FIG. 2 showing a connecting protrusion of a housing engaging with a mating groove of a fastening piece.
Figure 4:
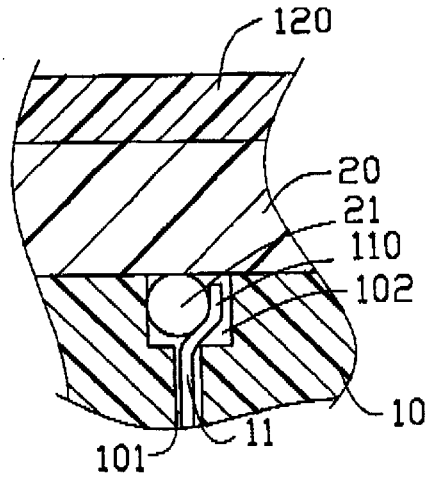
FIG. 4 is a partial cross-sectional view taken along line 4—4 of FIG. 2 showing a solder ball of the chipset engaging with a terminal of the connector.

Referring to FIGS. 2 to 4, in assembly, the solder ball 21 of the chipset 2 are inserted into the corresponding receiving recesses 102 to deform the contact portions 110 of the terminals 11. The resilient force of the deformation ensures proper electrical connection between the connector 1 and the chipset 2. As soon as the fastening piece 12 is attached to the housing 10, the mating grooves 122 of the fastening piece 12 snap with the connecting protrusions 103 of the housing 10 thereby securely sandwiching the chipset 2 between the housing 10 and the fastening piece 12. Thus, the chipset 2 is easily and detachably assembled to the connector 1.

Figure 5:
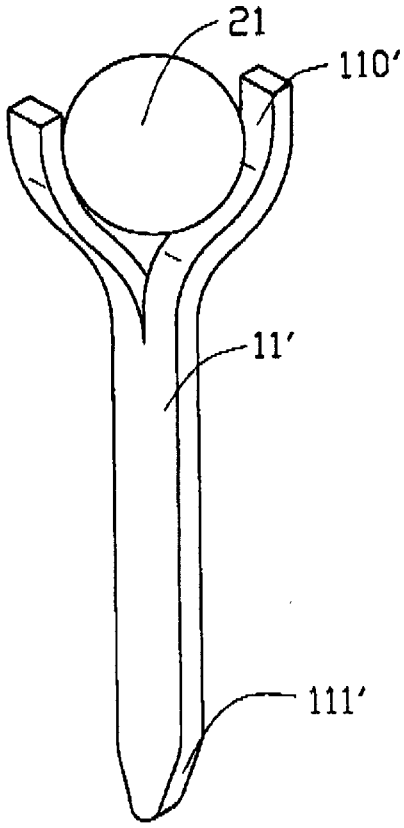
FIG. 5 is a perspective view of a terminal in accordance with a second embodiment of the present invention.
Figure 6:
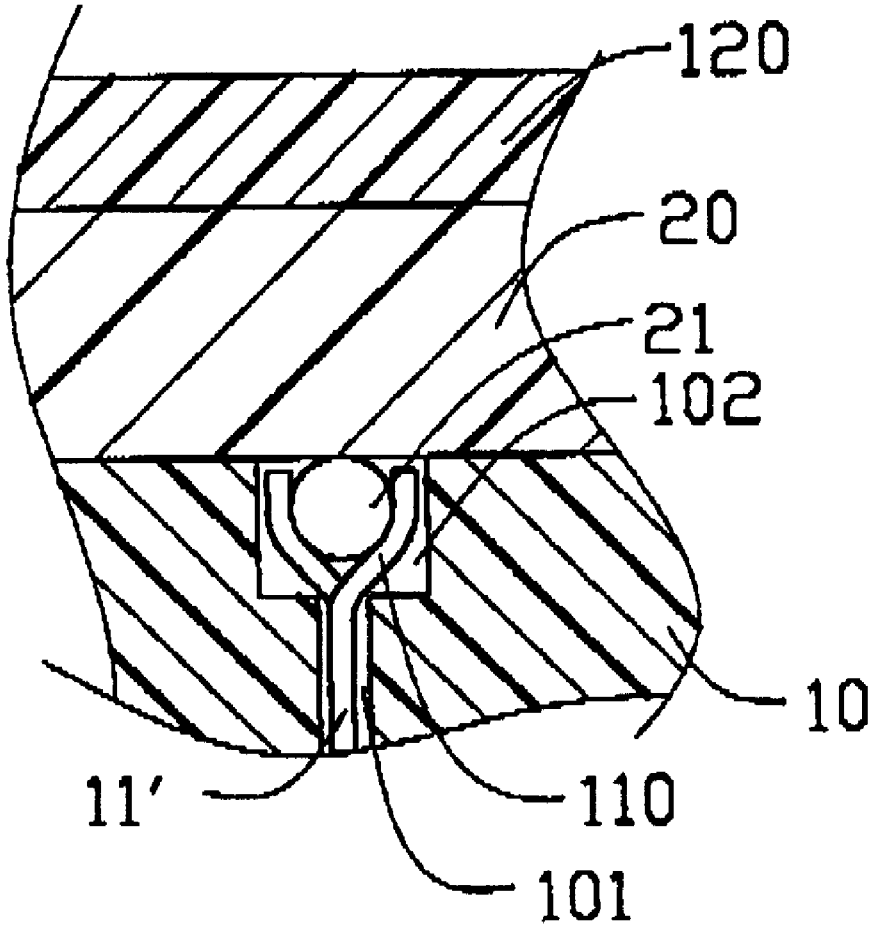
FIG. 6 is a view similar to FIG. 4, showing a solder ball of the chipset engaging with the terminal of the second embodiment.

For facilitating understanding, like components are designated by like reference numerals in a second embodiment as shown in FIGS. 5 and 6. The contact portion 110' of the terminal 11' is bifurcated, and each branch of the contact portion 110' forms a curved, resilient end. The solder balls 21 of the chipset 2 are received between the branches of the corresponding terminals 11' to electrically engage therewith.

It will be understood that the present invention may be embodied in other specific forms without departing from the spirit of the central characteristics thereof. The present examples and embodiments, therefore, are to be considered in all respects as illustrative and not restrictive, and the invention is not to be limited to the details given herein.

What is claimed is:

1. An electrical connector assembly comprising:

a dielectric housing having a plurality of terminal receiving passageways defined between a top mating face and a bottom terminating face thereof and a pair of connecting portions formed on opposite sides of the dielectric housing;

a plurality of terminals received in the corresponding passageways of the housing, each terminal having a contact portion near the top mating face and an opposite tail portion near the bottom terminating face;

a chipset placed over the dielectric housing, said chipset including solder balls on a bottom surface; and a fastening piece mounted to the housing with the chipset securely sandwiched therebetween, the fastening piece including a body and a pair of legs extending substantially perpendicular from distal ends of the body, each leg defining a mating portion for attaching to a corresponding connecting portion of the housing;

wherein each of the contact portions of the terminals forms a curved resilient end extending toward the top mating face of the housing for contacting with a corresponding solder ball of the chipset.

2. The electrical connector assembly as described in claim 1, wherein said mating portion of the leg comprises a groove and said connecting portion of the housing comprises a protrusion received in the groove.

3. The electrical connector assembly as described in claim 2, wherein the protrusion of said connecting portion has a slant face on a side of the housing proximate the top mating face.

4. The electrical connector assembly as described in claim 1, wherein receiving recesses are formed in said top mating face of the housing in communication with the corresponding passageways, said contact portions of the terminals being received in the corresponding receiving recesses.

5. An electrical connector assembly comprising:

a dielectric housing having a plurality of terminal receiving passageways defined between a top mating face and a bottom termination face thereof;

a plurality of terminals received within the corresponding passageways of the housing, each terminal having a contact portion and an opposite tail portion, each contact portion forming a curved, resilient end extending toward the top mating face of the housing;

a chipset placed on the dielectric housing and including solder balls on a bottom surface, each solder ball being engaged with the curved resilient end of a corresponding contact portion; and a fastening piece mounted to the housing with the chipset sandwiched therebetween thereby applying a vertical force upon the chipset against the housing, and thus each of the solder balls strongly pressing downward against the curved, resilient end of the contact portion of the corresponding terminal.

6. The electrical connector assembly as described in claim 1, wherein each of the contact portions of the terminals further forms a second curved resilient end bifurcated from the curved resilient end, the curved resilient end and the second curved resilient end cooperatively extending for contacting corresponding solder ball of the chipset.

* * * * *